US009589440B2

(12) United States Patent
Pan et al.

(10) Patent No.: US 9,589,440 B2
(45) Date of Patent: Mar. 7, 2017

(54) LAMP TUBE AND LAMP FIXTURE WITH SENSING CAPABILITY

(71) Applicant: LUXUL TECHNOLOGY INCORPORATION, New Taipei (TW)

(72) Inventors: Cheng-Hung Pan, New Taipei (TW); Eric Wen-Chien Chen, New Taipei (TW); Perng-Fei Yuh, New Taipei (TW); Yung-Ta Hung, New Taipei (TW); Cheng-Hsien Chen, New Taipei (TW)

(73) Assignee: LUXUL TECHNOLOGY INCORPORATION, New Taipei (TW)

( * ) Notice: Subject to any disclaimer, the term of this patent is extended or adjusted under 35 U.S.C. 154(b) by 0 days.

(21) Appl. No.: 14/753,638

(22) Filed: Jun. 29, 2015

(65) Prior Publication Data

US 2016/0307422 A1 Oct. 20, 2016

(30) Foreign Application Priority Data

Apr. 20, 2015 (TW) ..... 104112540 A

(51) Int. Cl.
*G08B 17/103* (2006.01)
*G08B 17/113* (2006.01)
*G08B 17/117* (2006.01)

(52) U.S. Cl.
CPC ..... *G08B 17/113* (2013.01); *G08B 17/117* (2013.01)

(58) Field of Classification Search
CPC ..... G08B 17/103; G08B 17/10; G08B 17/107; G08B 17/11; G08B 17/117; G08B 29/183
See application file for complete search history.

(56) References Cited

U.S. PATENT DOCUMENTS 5,261,596 A * 11/1993 Tachibana ..... F24F 11/0009 165/248
6,107,925 A * 8/2000 Wong ..... G08B 17/10 340/628
6,494,777 B1 * 12/2002 Chiang ..... B60H 1/008 454/139
6,914,534 B2 * 7/2005 Tanguay ..... G08B 5/38 340/286.05
7,030,748 B2 * 4/2006 Tanguay ..... G08B 5/38 340/509
2004/0095253 A1 * 5/2004 Tanguay ..... G08B 5/38 340/691.2
2005/0151663 A1 * 7/2005 Tanguay ..... G08B 5/38 340/691.2

(Continued)

*Primary Examiner* — Van Trieu
(74) *Attorney, Agent, or Firm* — Rabin & Berdo, P.C.

(57) ABSTRACT

A lamp tube and a lamp fixture with sensing capability are disclosed. The lamp tube with sensing capability includes a lamp tube body, and the lamp tube body includes a power converting unit, an LED strip and a sensing unit. The power converting unit is for receiving AC power and outputting DC power for driving the LED strip and the sensing unit. The sensing unit will timely output a fire alarm signal to notify the firemen and the people nearby when a fire occurs. The shape of the lamp tube with sensing capability is the same as a normal lamp tube, so both of them can be installed in the same lamp fixture. One normal lamp tube is replaced by the lamp tube with sensing capability to include a fire sensing function. The safety is enhanced and the installation is convenient.

12 Claims, 4 Drawing Sheets

(56) References Cited

U.S. PATENT DOCUMENTS

| | | | | |
|---|---|---|---|---|
| 2007/0111655 | A1* | 5/2007 | Song | F24F 11/0017<br>454/292 |
| 2014/0104067 | A1* | 4/2014 | Chien | G08B 17/10<br>340/628 |

* cited by examiner

LAMP TUBE AND LAMP FIXTURE WITH SENSING CAPABILITY

CROSS-REFERENCE TO RELATED APPLICATIONS

This application claims the benefit of Taiwan patent application No. 104112540, filed on Apr. 20, 2015, the disclosure of which is incorporated herein in its entirety by reference.

BACKGROUND OF THE INVENTION

1. Field of the Invention

The present invention relates to a lamp tube and a lamp fixture for holding the lamp tube, and more particularly to a lamp tube and a lamp fixture with a fire sensing capability.

2. Description of Related Art

Fire is one of the common disasters in today's society. Fires are mostly started from a spark, and the spark gradually grows into a fire disaster. The fire disaster, which is hard to be extinguished, threatens people's lives, causes huge property damages, and increases social costs for putting out the fire. When the fire is weak, it is easy to extinguish the fire. Therefore, if the spark can be discovered as soon as possible, the damage and threat can be minimized.

A conventional flame detector can detect a fire source in a space by sensing smoke, concentration of carbon dioxide or temperature. When a fire occurs, a fire sprinkler firstly sprinkles water over the fire to extinguish the fire. Meanwhile, firemen are notified to assist people in an emergency evacuation. Because of the installation of the flame detector, people can be evacuated in a timely manner to reduce life threatening and the firemen can be immediately notified to extinguish fire so as to prevent the fire from continuing to expand and reduce property damages.

The conventional flame detector is installed at a fixed location within a space. However, fire can occur at any locations in the space. When the location where the fire occurs is far away from the installation location of the flame detector, the flame detector may fail to detect the fire source as soon as possible, such that a purpose of timely evacuating people cannot be achieved. Moreover, in the installation of flame detector, the flame detector needs a wire to be electrically connected to a power source to be workable. Accordingly, it is inconvenient for a user to connect the wire to the flame detector.

SUMMARY OF THE INVENTION

Since the location of the conventional flame detector is fixed, the occurrence of the fire cannot be detected accurately in a timely manner. In addition, the conventional flame detector needs a power line to be connected to a power source to acquire electric energy to be workable. Therefore, the installation of the conventional flame detector is inconvenient. An objective of the present invention is to provide a lamp tube with sensing capability and a lamp fixture with sensing capability, and the lamp tube and the lamp fixture can be easily installed in various locations.

In order to achieve the aforementioned objective, the lamp tube with sensing capability in the present invention comprises:

a lamp tube body comprising:

a power converting unit electrically connected to an external power source to receive an AC power, convert the AC power into a DC power, and output the DC power;

an LED strip electrically connected to the power converting unit for receiving the DC power; and a sensing unit electrically connected to the power converting unit for receiving the DC power and generating a fire alarm signal when the sensing unit detects an occurrence of a fire.

Since the lamp tube with sensing capability includes the sensing unit, the sensing unit can detect the occurrence of the fire and output a fire alarm signal to notify the firemen and evaluate the people nearby when the fire occurs. The shape of the lamp tube with sensing capability is the same as the normal lamp tube and the sensing tube can be directly installed in the current lamp fixture to receive power without additionally connecting the external power source via the power line to acquire the power energy. In addition, the lamp fixtures are the conventional equipments, which already exist and are normally installed at various locations within the room. When the lamp tube with sensing capability in the present invention is implemented, the original lamp tube is removed and replaced with the lamp tube with sensing capability in the present invention to detect the occurrence of the fire within the room so as to enhance the convenience of the installation.

A lamp fixture with sensing capability of the present invention comprises:

a power converting unit electrically connected to an external power source to receive an AC power, convert the AC power to a DC power, and output the DC power; and a sensing unit electrically connected to the power converting unit for receiving the DC power and generating a fire alarm signal when the sensing unit detects an occurrence of a fire.

Since the lamp tube with sensing capability includes the sensing unit, the sensing unit can detect the occurrence of the fire and correspondingly output a fire alarm signal to notify the firemen or warn the people nearby to evacuate. The lamp fixture with sensing capability is for installing the LED lamp tube and is installed during interior decoration of the room. A bigger room would have more LED lamp tubes. The LED lamp tubes are evenly installed in the room to provide enough illumination to lighten the room. Therefore, the number of the lamp fixtures with sensing capability is increased and the lamp fixtures with sensing capability are evenly installed in the room. The lamp fixtures with sensing capability in the room include the sensing units respectively, so the condition at each of the corners can be detected to find out the occurrence of the fire so as to react in a timely manner.

DETAILED DESCRIPTION OF THE PREFERRED EMBODIMENT

These and other aspects of the embodiments herein will be better appreciated and understood when considered in conjunction with the following description and the accompanying drawings.

Figure 1:
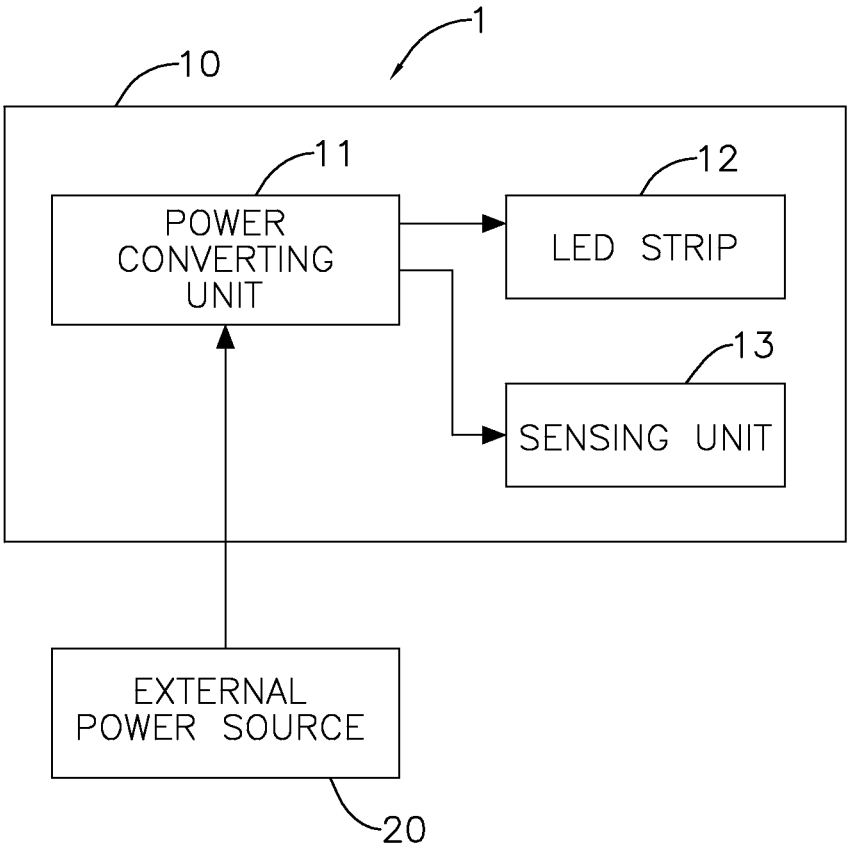
FIG. 1 is a block diagram of a lamp tube with sensing capability of the present invention.

Please refer to FIG. 1. The present invention discloses a lamp tube with sensing capability 1. The lamp tube with sensing capability 1 of the present invention includes a lamp tube body 10. The lamp tube body 10 includes a power converting unit 11, a light emitting diode (LED) strip 12, and a sensing unit 13.

The power converting unit 11 is electrically connected to an external power source 20 for receiving alternating current (AC) power and converts the AC power to output a direct current (DC) power. The LED strip 12 is electrically connected to the power source converting unit 11 for receiving the DC power to illuminate the LED strip 12.

The sensing unit 13 is electrically connected to the power converting unit 11 for receiving the DC power, which is used for operating the sensing unit 13. When the sensing unit 13 detects an occurrence of a fire, the sensing unit 13 outputs a fire alarm signal to notify the firemen or evaluate the people nearby in a timely manner.

Figure 2:
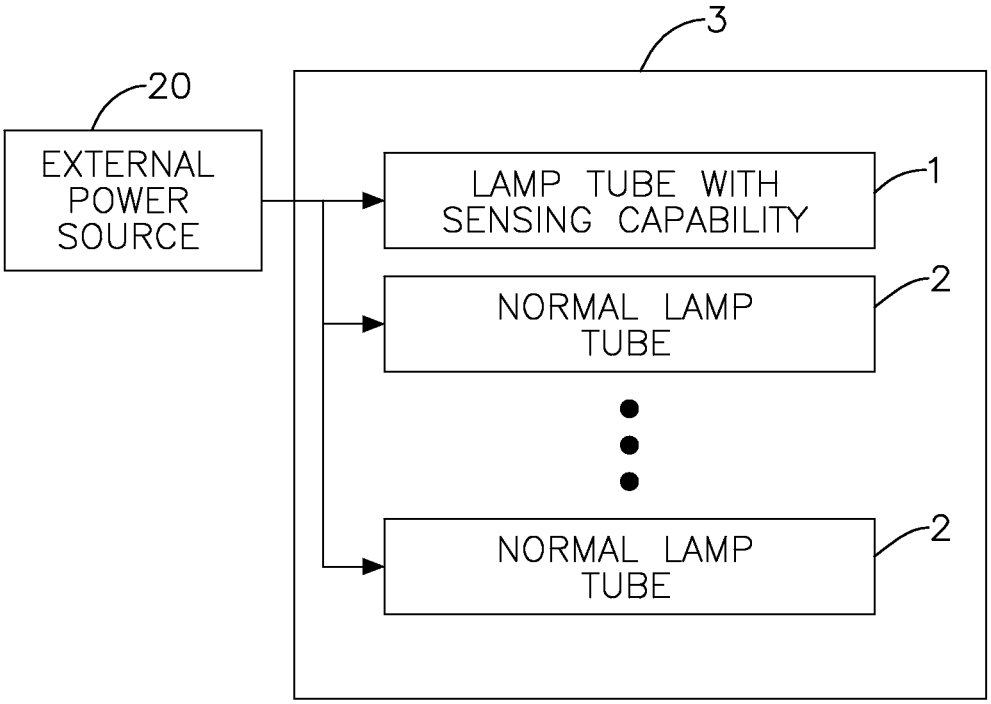
FIG. 2 is a block diagram of a sensing unit of the lamp tube with sensing capability of the present invention.

With reference to FIG. 2, since the shape of the lamp tube with sensing capability 1 is the same as a normal lamp tube 2, both of them can be installed in the same lamp fixture 3. For example, a plurality of the normal lamp tubes 2 can be installed in the lamp fixture 3. When it is requested to implement the lamp tube with sensing capability 1, one of the normal lamp tubes 2 can be removed and replaced with the lamp tube with sensing capability 1. The lamp tube with sensing capability 1 can illuminate normally and has capability to detect fire so as to have an installation convenience. In addition, it is necessary to illuminate every corner in a room and the lamp fixtures 3 are evenly installed within the room. Therefore, any one of the normal lamp tubes 2 in each of the lamp fixtures 3 can be replaced with the lamp tube with sensing capability 1 within the room and the lamp tubes with sensing capability 1 can be evenly installed within the room to detect the occurrence of the fire in any corners of the room. Failure to detect fire at every corner within the room caused by the limitation that only one lamp tube with sensing capability 1 is installed in a fixed location can be avoided.

Figure 3:
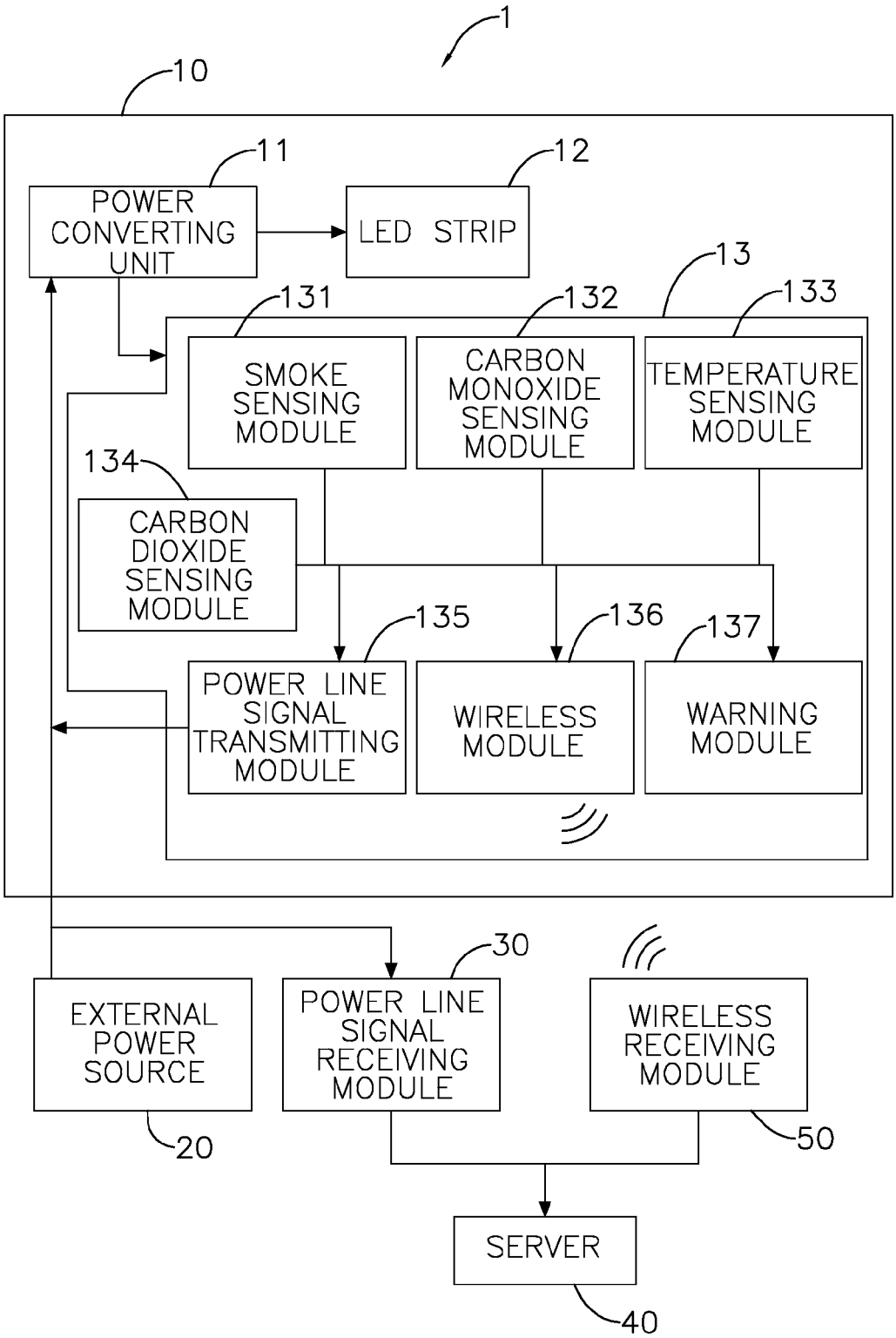
FIG. 3 is a block diagram of the lamp tube with sensing capability of the present invention, implemented in a normal lamp.

With reference to FIG. 3, the sensing unit 13 includes a smoke sensing module 131, a carbon monoxide sensing module 132, a temperature sensing module 133, a carbon dioxide sensing module 134, or any combination thereof. In the preferred embodiment, the sensing unit 13 includes the smoke sensing module 131, the carbon monoxide sensing module 132, the temperature sensing module 133, and the carbon dioxide sensing module 134.

The smoke sensing module 131 is used to sense whether smoke exists in the room and finds out if a smoke concentration is higher than a threshold value.

When the smoke sensing module 131 detects that the smoke concentration is higher than the threshold value in the room, the fire alarm signal is generated and the people nearby are notified to evacuate from the room.

The carbon monoxide sensing module 132 is for sensing whether carbon monoxide exists in the room. When the carbon monoxide exists in the air within the room, the alarm signal is generated to notify the firemen to take action. When the carbon monoxide exists in the air within the room, this means that the carbon monoxide is produced by incomplete combustion from use of the water heater or the gas stove. Since carbon monoxide is easier to be absorbed by human beings compared to oxygen, the humans cannot obtain the oxygen, resulting in hypoxia so as to lead to death. In addition, carbon monoxide is odorless and colorless, and it is not easy to be detected. The existence of carbon monoxide in the air within the room won't cause fire, but carbon monoxide is deadly dangerous for humans. Therefore, the carbon monoxide sensing module 132 is used to sense the air within the room. As long as the carbon monoxide exists in the air within the room, the firemen are notified to take action to avoid the occurrence of the incident.

The temperature sensing module 133 is for sensing the ambient temperature within the room. When the ambient temperature is higher than a threshold temperature, the alarm signal is generated to notify the firemen to take action and warn the people nearby to evacuate. Moreover, the temperature sensing module 133 further has an additional function. When the space of the room is huge, the temperature within the room at each of the corners won't be the same. For example, the overall space in an open office is huge, and the distribution of the temperature is uneven when air conditioning is turned on during summer or when heater is turned on during winter. It would cause the room colder at one side and hotter at the other side. Therefore, if one of the normal lamp tubes in one of the lamp fixtures in the office is replaced with the lamp tube with sensing capability 1, the temperature sensing module 133 in each of the lamp tubes with sensing capability 1 can sense the ambient temperature so as to detect the temperature at each corner of the office. The air conditioning system can be adjusted in accordance with the temperature at each corner to balance the temperature at each corner of the office so as to avoid uneven distribution of the temperature.

The carbon dioxide sensing module 134 is for sensing the concentration of the carbon dioxide within the room. When the concentration of the carbon dioxide in the room is greater than a concentration threshold value, the alarm signal is generated to notify the firemen to take action. In addition, the carbon dioxide sensing module 134 further has an additional function. When there are too many people in the room, the carbon dioxide concentration is increased in the room. The carbon dioxide won't lead to death, but people will be sleepy when the concentration of the carbon dioxide is high. Therefore, the carbon dioxide sensing module 134 can sense the concentration of the carbon dioxide and the oxygen content within the room can be controlled in accordance with the concentration of the carbon dioxide by adjusting the air conditioning system.

The sensing unit 13 further includes a power line signal transmitting module 135, a wireless module 136, and a warning module 137. The power line signal transmitting module 135 is electrically connected to the smoke sensing module 131, the carbon monoxide sensing module 132, and the temperature sensing module 133 for receiving the fire alarm signal and the fire alarm signal is transmitted to a power line signal receiving module 30 via a power line, which is connected between the power converting unit 11 and the external power source 20. Thereafter, the fire alarm signal is transmitted to a server 40 to timely notify the firemen.

The wireless module 136 is used to transmit data as the power line signal transmitting module 135, but the fire alarm signal is wirelessly transmitted by the wireless module 136 to a wireless receiving module 50 and further transmitted to the server 40 from the wireless receiving module 50 to notify the firemen.

The warning module 137 is for generating an alarm when the fire alarm signal is received to notify the people nearby to evacuate.

Figure 4:
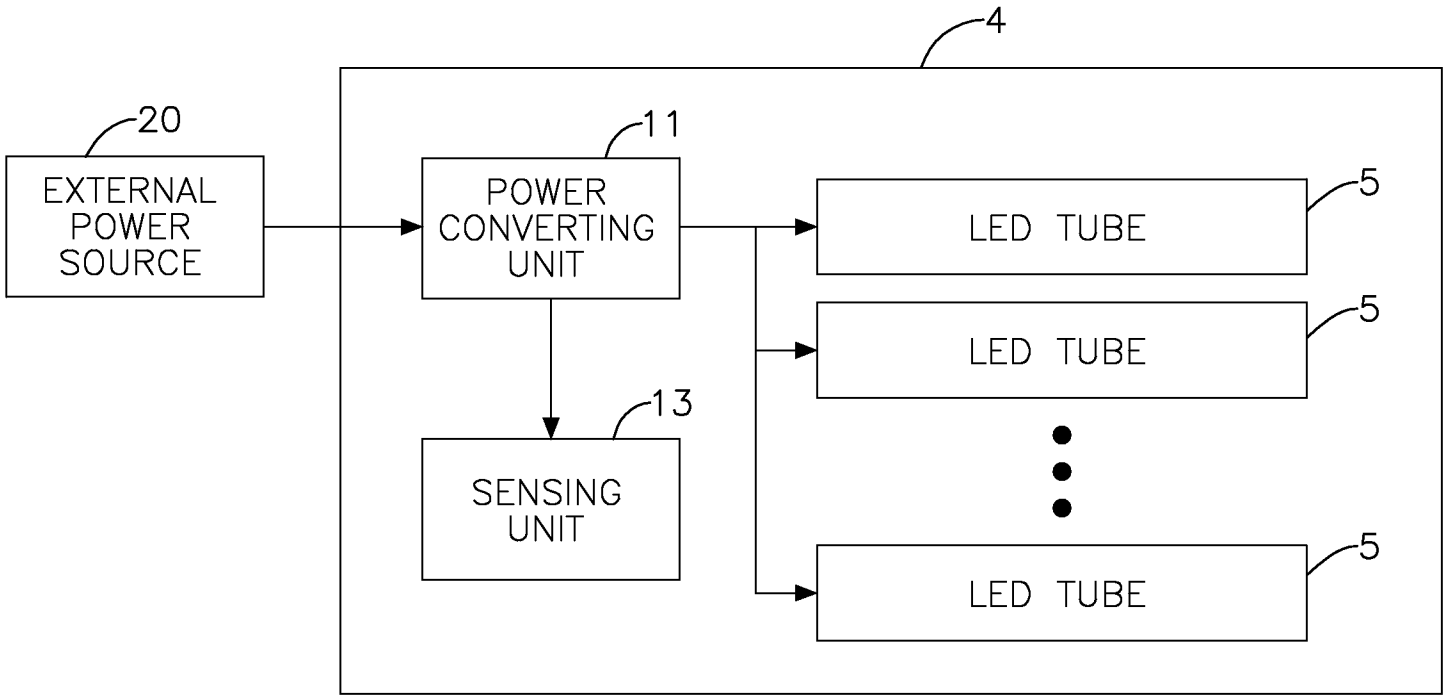
FIG. 4 is a block diagram of the lamp fixture with sensing capability of the present invention.

With reference to FIG. 4, the present invention also provides a lamp fixture with sensing capability 4. The lamp fixture with sensing capability 4 includes the power converting unit 11 and the sensing unit 13.

The power converting unit 11 is electrically connected to the external power source 20 for receiving the AC power and converting the AC power to DC power to output the DC power. The sensing unit 13 is electrically connected to the power converting unit 11 for receiving the DC power, which is used for operating the sensing unit 13. When the sensing unit 13 detects an occurrence of a fire, a fire alarm signal is generated to notify the firemen or people nearby to evacuate in a timely manner.

The lamp fixture with sensing capability 4 is for installing at least one LED tube 5. When the LED tube 5 is installed on the lamp fixture with sensing capability 4, the LED tube 5 is electrically connected to the power converting unit 11 for receiving the DC power to illuminate the LED tube 5.

The sensing unit 13 of the lamp fixture with sensing capability 4 is similar to the sensing unit 13 of the lamp tube with sensing capability 1. The difference is that the sensing unit 13 of the lamp fixture with sensing capability 4 is directly installed on the lamp fixture with sensing capability 4 instead of being installed within the lamp tube.

Since the lamp fixture with sensing capability 4 is the lamp fixture for installing the LED tube 5, the lamp fixtures with sensing capability 4 have been installed during interior decoration of the house. When the house is bigger, the number of the installation of the lamps is increased and the lamps are evenly installed in the room to provide sufficient light within the room. Therefore, the lamp fixtures with sensing capability 4 are evenly installed within the room. Each of the lamp fixtures with sensing capability 4 in the room includes the sensing unit 13, so each corner within the room can be detected to find out if fire occurs so as to respond timely and proceed properly.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A lamp tube with sensing capability, comprising:

a lamp tube body comprising:

a power converting unit electrically connected to an external power source to receive an AC power, and converting the AC power into a DC power so as to output the DC power;

an LED strip electrically connected to the power converting unit to receive the DC power; and a sensing unit electrically connected to the power converting unit to receive the DC power and generating a fire alarm signal when the sensing unit detects an occurrence of a fire, and including:

a temperature sensing module generating the fire alarm signal when the temperature sensing module detects that an ambient temperature is higher than a threshold temperature, and the temperature sensing module adjusting an air conditioning system based on the ambient temperature; and a carbon dioxide sensing module generating the fire alarm signal when the carbon dioxide sensing module detects that a concentration of carbon dioxide is higher than a concentration threshold, and the carbon dioxide sensing module adjusting an air conditioning system based on the concentration of the carbon dioxide.

2. The lamp tube with sensing capability as claimed in claim 1, wherein the sensing unit includes a smoke sensing module generating the fire alarm signal when the smoke sensing module detects a smoke concentration higher than a threshold value.

3. The lamp tube with sensing capability as claimed in claim 1, wherein the sensing unit includes a carbon monoxide sensing module generating the fire alarm signal when carbon monoxide is detected.

4. The lamp tube with sensing capability as claimed in claim 1, wherein the sensing unit includes:

a power line signal transmitting module receiving the fire alarm signal and transmitting the fire alarm signal via a power line electrically connected between the external power source and the power converting unit to a power line signal receiving module, and the power line signal receiving module transmitting the fire alarm signal to a server.

5. The lamp tube with sensing capability as claimed in claim 1, wherein the sensing unit includes:

a wireless module receiving the fire alarm signal and wirelessly transmitting the fire alarm signal to a wireless receiving module, and the wireless receiving module transmitting the fire alarm signal to a server.

6. The lamp tube with sensing capability as claimed in claim 1, wherein the sensing unit includes a warning module;

the warning module sets off alarms when the fire alarm signal is received.

7. A lamp fixture with sensing capability, comprising:

a power converting unit electrically connected to an external power source to receive an AC power, and converting the AC power into a DC power so as to output the DC power; and a sensing unit electrically connected to the power converting unit to receive the DC power and generating a fire alarm signal when the sensing unit detects an occurrence of a fire, and including:

a temperature sensing module generating the fire alarm signal when the temperature sensing module detects that an ambient temperature is higher than a threshold temperature, and the temperature sensing module adjusting an air conditioning system based on the ambient temperature; and a carbon dioxide sensing module generating the fire alarm signal when the carbon dioxide sensing module detects that a concentration of carbon dioxide is higher than a concentration threshold, and the carbon dioxide sensing module adjusting an air conditioning system based on the concentration of the carbon dioxide.

8. The lamp fixture with sensing capability as claimed in claim 7, wherein the sensing unit includes a smoke sensing module generating the fire alarm signal when the smoke sensing module detects a smoke concentration higher than a threshold value.

9. The lamp fixture with sensing capability as claimed in claim 7, wherein the sensing unit includes a carbon monoxide sensing module generating the fire alarm signal when carbon monoxide is detected.

10. The lamp fixture with sensing capability as claimed in claim 7, wherein the sensing unit includes:

a power line signal transmitting module receiving the fire alarm signal, and transmitting the fire alarm signal via a power line, which is electrically connected between the external power source and the power converting unit, to a power line signal receiving module, and the power line signal receiving module transmitting the fire alarm signal to a server.

11. The lamp fixture with sensing capability as claimed in claim 7, wherein the sensing unit includes:

a wireless module receiving the fire alarm signal and wirelessly transmitting the fire alarm signal to a wireless receiving module, and the wireless receiving module transmitting the fire alarm signal to the server.

12. The lamp fixture with sensing capability as claimed in claim 7, wherein the sensing unit includes a warning module;

the warning module sets off alarms when the fire alarm signal is received.

* * * * *